US006161949A

United States Patent [19]

Johnson

[11] Patent Number: 6,161,949

[45] Date of Patent: Dec. 19, 2000

[54] REPLICA FLAME

[76] Inventor: Jac Nolan Johnson, 1075 S. Pope, apt. 96, Nashville, Ark. 71852

[21] Appl. No.: 09/360,511

[22] Filed: Jul. 26, 1999

Related U.S. Application Data

[63] Continuation-in-part of application No. 08/864,214, May 24, 1997, Pat. No. 5,927,959.

[51] Int. Cl.[7] ..... F23Q 2/32

[52] U.S. Cl. ..... 362/447; 362/120; 362/119; 362/159; 362/171; 362/178; 362/392; 362/810; 362/806

[58] Field of Search ..... 362/551, 569, 362/581, 34, 109, 119, 120, 157, 159, 171, 178, 382, 392, 433, 447, 806, 810; 428/7, 11, 15

[56] References Cited

U.S. PATENT DOCUMENTS

| | | | |
|---|---|---|---|
| D. 207,245 | 3/1967 | Lynn | D7/683 |
| D. 313,107 | 12/1990 | Maddock | D1/105 |
| 1,980,251 | 11/1934 | Becker | 431/125 |
| 2,058,584 | 10/1936 | Gastel | 431/296 |
| 2,154,618 | 4/1939 | Howard | 431/34 |
| 2,367,611 | 1/1945 | Raymond | 428/7 |
| 2,436,995 | 3/1948 | Hamilton | 431/125 |
| 2,465,700 | 3/1949 | Tuttle | 362/307 |
| 2,476,011 | 7/1949 | Wise | 428/7 |
| 2,689,149 | 9/1954 | Saltzman | 293/33 |
| 2,723,111 | 11/1955 | Lawrence | 416/71 |
| 3,363,436 | 1/1968 | Rutesic | 431/125 |
| 4,680,683 | 7/1987 | Schenke et al. | 362/190 |
| 5,118,198 | 6/1992 | Ault et al. | 366/47 |
| 5,327,332 | 7/1994 | Hafemeister | 362/392 |

FOREIGN PATENT DOCUMENTS 1293606 9/1962 France .

*Primary Examiner*—Stephen Husar
*Assistant Examiner*—Ismael Negron
*Attorney, Agent, or Firm*—Michael I Kroll

[57] ABSTRACT

A replica flame for simulating a flame on a wick extending from a top of a candle positioned in a candlestick. The replica flame includes a three-dimensional flame body and a rigid pin connected to extend from a base side of the three-dimensional flame body. The rigid pin includes a pointed end opposite the connection with the three-dimensional flame body, the rigid pin being able to pierce the top of the candle for releasably connecting the three-dimensional flame body to the top end of the candle at the wick. When releasably secured to the top of the candle, the replica flame creates an illusion of a flame burning on the wick of the candle thereby producing the appearance that the candle is lit. The three-dimensional flame body may include a vertical groove on one side thereof for receiving the wick of the candle and is preferably a pear shaped member having realistic colors of a natural flame duplicated thereon. The pear shaped member may include commercial coloring agents imbedded therein and applied onto an outer surface thereof, an additional treatment of glitter material or flame emulating reflecting agents, for optimizing realism as if the candle is really burning and/or an additional treatment of fluorescent material to optimize realism as if the candle is really burning.

12 Claims, 3 Drawing Sheets

REPLICA FLAME

REFERENCE TO RELATED APPLICATIONS

This application is a continuation-in-part application of U.S. Ser. No. 08/864,214 field on May 24, 1997, now U.S. Pat. No. 5,927,959.

BACKGROUND OF THE INVENTION

1. Field of the Invention

The instant invention relates generally to vertical holding devices and, more specifically, to a replica flame for simulating a three-dimensional flame on a top end of a candle thereby providing the appearance of the candle being lit without the wick being burned or wax dripping therefrom.

2. Description of the Prior Art

Numerous vertical holding devices have been provided for simulating a flame in prior art. For example, U.S. Pat. No. 2,689,149 issued to Saltzman; U.S. Pat. No. 2,723,111 issued to Lawrence; U.S. Pat. No. Des. 207,245 issued to Lynn and U.S. Pat. No. Des. 313,107 issued to Maddock all are illustrative of such prior art. While these units may be suitable for the particular purpose to which they address, they would not be as suitable for the purposes of the present invention as heretofore described.

U.S. Pat. No. 2,689,149

Inventor: Philip A. Saltzman

A drinking tube has a flexible laterally extending projection to be rolled or folded till the tube is needed for use. The projection has a notch in one side to engage the rim of the mouth of a bottle into which the tube is inserted. The tube comprises a spiral strip wound into helical turns. The projection has its inner end gripped between the overlapping edges of two adjacent turns of the strip. The strip is in a diagonal position with respect to the turns and extends laterally outward from the body of the tube.

U.S. Pat. No. 2,723,111

Inventor: Hallett T. Lawrence

A drink-stirring implement of the kind wherein an elongated handle, approximately rectangular in transverse section, has a paddle at one end. The handle and paddle are an integral mass of hard, impervious, shaped-retaining material, characterized in that the paddle is wafer-like having a smooth, flat rear face, located substantially in the plane of the longitudinal axis of the handle. The front face of the paddle is bounded by a forwardly directed rib that defines a field for display of identifying indicia. The forward face of which is in substantially the same plane as the front face of the handle and whose outer edge surface extends rearwardly to the rear face of the paddle and forms the marginal edge of the paddle. The display field has identifying indicia projecting forwardly from the field with its forward face substantially in the plane of the front edge of the rib. The handle is provided with a bead at the end opposite the paddle. That end portion of the handle which is united to the paddle is offset rearwardly from the rear face of the paddle and extends above the lowest point of the paddle.

U.S. Pat. No. Des. 207,245

Inventor: Homer Lynn

The ornamental design for a sandwich pick or the like, substantially as shown. FIG. 1 is a perspective view of the sandwich pick or the like showing the new design; FIG. 2 is a front view thereof; FIG. 3 is a side view thereof, and FIG. 4 is a plan view thereof.

U.S. Pat. No. Des. 313,107

Inventor: Marcia Maddock

The ornamental design for a holder for cookies, as shown and described. FIG. 1 is a top perspective view of the holder for cookies showing the new design; FIG. 2 is a right side elevational view thereof, the undisclosed left side being substantially the same; FIG. 3 is a front elevational view thereof, with a cookie shown in broken lines for illustrative purposes only and forming no part of the claimed design; FIG. 4 is a top plan view thereof; and FIG. 5 is a bottom plan view thereof.

SUMMARY OF THE INVENTION

The instant invention relates generally to vertical holding devices and, more specifically, to a replica flame for simulating a three-dimensional flame on a top end of a candle thereby providing the appearance of the candle being lit without the wick being burned or wax dripping therefrom.

A primary object of the present invention is to provide a replica flame that will overcome the shortcomings of the prior art devices.

Another object of the present invention is to provide a replica flame of single or multiple piece assembly for simulating a three dimensional flame connected to a top end of a candle to complete a decorating scheme or accent a decor wherever a candle is needed.

A further object of the present invention is to provide a replica flame able to simulate a three-dimensional flame connected to a top end of a candle to complete a decorating scheme where a candle is needed.

An additional object of the present invention is to provide a replica flame able to produce a uniquely realistic appearance for a candle which seems lighted, yet is not lighted, thereby being a safe product that will enhance realism to the candle.

A further object of the present invention is to provide a replica flame able to be removably connected to a top side of a candle without damaging the candle.

A yet further object of the present invention is to provide a replica flame able to accommodate the wick of the candle thereby preventing the wick from protruding from a side of the replica flame.

A further object of the present invention is to provide a replica flame that is simple and easy to use.

A still further object is to provide a replica flame that is economical in cost to manufacture.

Further objects of the invention will appear as the description proceeds.

A replica flame for simulating a flame on a wick extending from a top of a candle positioned in a candlestick is disclosed by the present invention. The replica flame includes a three-dimensional flame body and a rigid pin connected to extend from a base side of the three-dimensional flame body. The rigid pin includes a pointed end opposite the connection with the three-dimensional flame body, the rigid pin being able to pierce the top of the candle for releasably connecting the three-dimensional flame body to the top end of the candle at the wick. When releasably secured to the top of the candle, the replica flame creates an illusion of a flame burning on the wick of the candle thereby producing the appearance that the candle is lit. The three-dimensional flame body may include a vertical groove on one side thereof for receiving the wick of the candle and is preferably a pear shaped member having realistic colors of a natural flame duplicated thereon. The pear shaped member may include commercial coloring agents imbedded therein and applied onto an outer surface thereof, an additional treatment of glitter material or flame emulating reflecting agents, for optimizing realism as if the candle is really burning and/or an additional treatment of fluorescent material to optimize realism as if the candle is really burning.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views, and wherein.

DESCRIPTION OF THE REFERENCE NUMERALS

Figure 1:
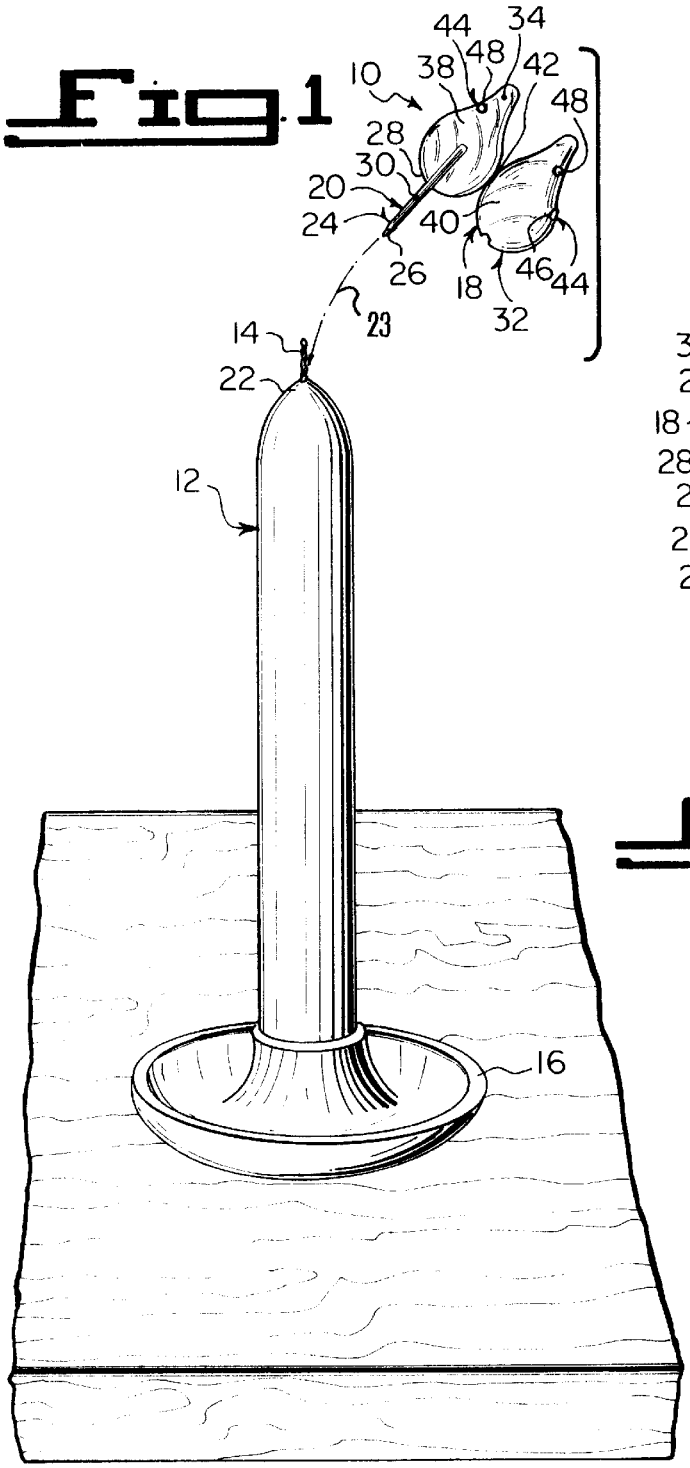
FIG. 1 is a perspective view of a candle in a candlestick, showing the replica flame of the present invention having an elongated rigid pin with a pointed tip ready to be inserted into a top end of the candle.

Turning now descriptively to the drawings, in which similar reference characters denote similar elements throughout the several views, the Figures illustrate the ladder including storage areas of the present invention. With regard to the reference numerals used, the following numbering is used throughout the various drawing figures.

| | |
|---|---|
| 10 | replica flame of the present invention |
| 12 | candle |
| 14 | wick of candle |
| 16 | candlestick for retaining candle in an upright position |
| 18 | simulated three-dimensional flame body of replica flame |
| 20 | connecting structure of replica flame |
| 22 | top end of candle |
| 23 | dot dashed arrow indicating direction of movement of replica flame for connection to top of candle |
| 24 | elongated rigid pin of connecting structure |
| 26 | pointed tip on elongated pin |
| 28 | bottom end of simulated three-dimensional flame body |
| 30 | material for elongated rigid pin |
| 32 | pear shaped member for simulated three-dimensional flame body |
| 34 | material for pear shaped member |
| 36 | vertical groove in pear shaped member for receiving wick of candle |
| 38 | first equal half segment of pear shaped member |
| 40 | second equal half segment of pear shaped member |
| 42 | side hinge between first and second half segments of pear shaped member |
| 44 | closing facility for first and second half segments of pear shaped member |
| 46 | clasp for closing facility on second half segment |
| 48 | male/female snap closure for closing facility |
| 50 | dot dashed arrow indicating direction of movement of replica flame for connection to top of candle |
| 52 | connector for connecting pin to pear shaped member |
| 54 | underside of pear shaped member |

DETAILED DESCRIPTION OF THE PREFERRED EMBODIMENT

Turning now descriptively to the drawings, in which similar reference characters denote similar elements throughout the several views, FIGS. 1 through 7B illustrate the replica flame of the present invention indicated generally by the numeral 10.

The replica flame 10 of the present invention is provided for connection to a top end 22 of a candle 12 having a wick 14. A candle 12 is shown in FIG. 1 maintained in an upright position by a candlestick 16. The replica flame 10 includes a simulated three-dimensional flame body 18 and a structure 20 for selectively and releasably connecting the simulated three-dimensional flame body 18 to the top end 22 of the candle 12 at a position adjacent the wick 14. The replica flame 10 acts to produce the uniquely realistic appearance of a lit candle 12 when positioned on the top side of the candle 12. The candle 12 thus maintains the illusion of being lit while unlighted, thereby providing a safe product that provides a desired effect by enhancing the illusion of the candle 12 being lit.

The connecting structure 20 is preferably formed by an elongated rigid pin 24 having a pointed tip 26. The elongated rigid pin 24 extends from a bottom end 28 of the simulated three-dimensional flame body 18. The pointed tip 26 is able to be inserted into the top end 22 of the candle 12 adjacent the wick 14 as indicated by the dot dashed arrow 23 to thereby retain the simulated three-dimensional flame body 18 in position atop the candle 12. The elongated rigid pin 24 is fabricated out of a material 30 selected from the group consisting of metal, plastic and wood, ceramic, any suitable rigid material and any combination thereof.

The simulated three-dimensional flame body 18 is a pear shaped member 32 having colors which realistically depict the natural colors of a flame duplicated thereon. The pear shaped member 32 can include commercial coloring agents imbedded therein and applied onto an outer surface thereof to further enhance the resemblance to a flame. The pear shaped member 32 can also further include an additional treatment of glitter material or flame emulating reflecting agents, for realistically depicting an image that the candle 12 is burning. Additionally, the pear shaped member 32 can include an additional treatment of fluorescent material to further enhance the illusion that the candle is burning.

The pear shaped member 32 is fabricated out of a material 34 selected from at least one of papier-mâché, injected/extruded plastic, ceramic, china, glass, porcelain, plaster, wood, metal and any combination thereof. The pear shaped member 32 is constructed according to a technique selected from the group consisting of stamping, forming, molding and casting.

Figure 2:
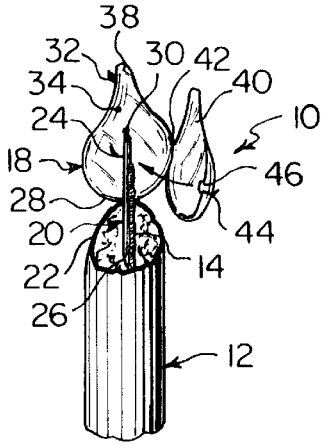
FIG. 2 is a perspective view of an upper portion of the candle with parts broken away, showing the elongated rigid pin of the replica flame of the present invention inserted into a top end of the candle.
Figure 3:
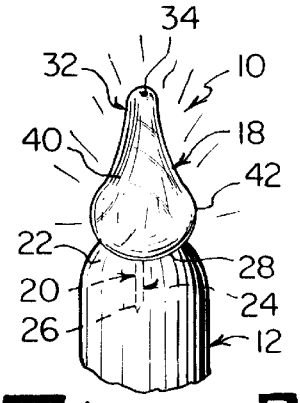
FIG. 3 is a perspective view of the upper portion of the candle, showing the elongated rigid pin of the replica flame of the present invention inserted into the top end of the candle and the two equal half segments of the pear shaped member closed about the wick of the candle.

The pear shaped member 32 shown in FIGS. 1, 2 and 3 contains a vertical split therethrough dividing the pear shaped member 32 into first and second half segments 38 and 40, respectively. The first and second half segments 38 and 40 preferably have equal dimensions providing for a flush surface without a noticeable seam when secured together. A side hinge 42 is positioned between the first and second half segments 38 and 40 for pivotally connecting the first and second half segments 38 and 40 together. A facility 44 is provided on a side of the first and second half segments opposite the side hinge 42 for releasably securing the first and second half segments 38 and 40 together. After releasably securing the rigid pin 24 to the top side 22 of the candle 12, the facility 44 secures the first and second half segments 38 and 40 together about the wick 14 of the candle 12. The wick 14 is thus retained between the first and second half segments 38 and 40 and thus does not extend from a side of the pear shaped member 32 and detract from the illusion of the lit candle 12. In this structure, the rigid pin 24 is secured to extend from either of the first and second half segments 38 or 40.

A partial cross-sectional view of the top 22 of the candle 12 showing the rigid pin 24 extending therein to releasably connect the replica flame 10 to the candle 12 is shown in FIG. 2. This figure illustrates the first and second half segments 38 and 40 in an open position. In this position, the wick 14 is moved between the first and second half segments 38 and 40. The first and second half segments 38 and 40 are then pivoted towards each other about the side hinge 42 whereby the facility 44 acts to secure the first and second half segments 38 and 40 together as shown in FIG. 3. The wick 14 is secured in position between the first and second half segments 38 and 40 thereby preventing the wick 14 from extending to a side of the replica flame 10 and diminish the illusionary effect of the replica flame 10.

Figure 7:
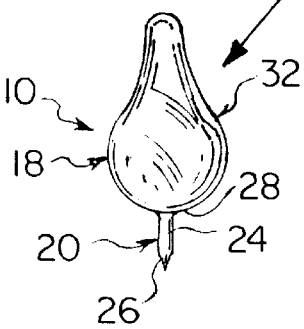
FIG. 7 is a side view of the replica flame of the present invention.

The closing facility 44 can be a clasp 46 on the half segment 40 of the pear shaped member 32. The closing facility 44 as shown in FIG. 1, can also be a male/female snap closure 48 between the two equal half segments 38 and 40 of the pear shaped member 32. In FIG. 7, the pear shaped member 32 is made without the vertical groove 36, while the elongated rigid pin 24 is integral with and extends from the bottom end 28 thereof.

Figure 4:
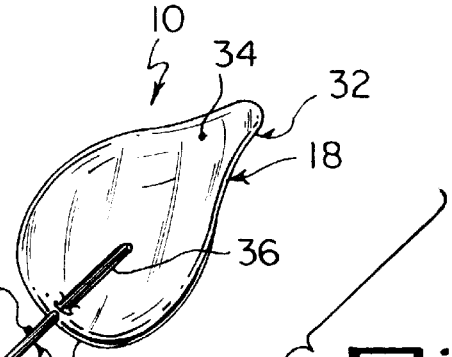
FIG. 4 is a perspective view of an upper portion of a candle, showing the replica flame of the present invention having an elongated rigid pin with a pointed tip ready to be inserted into a top end of the candle.
Figure 5:
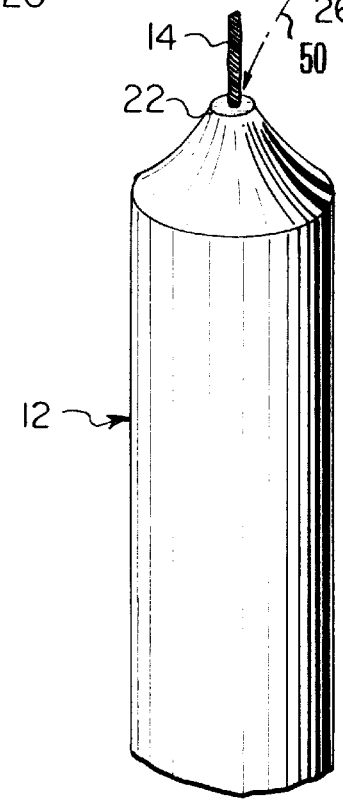
FIG. 5 is a bottom view of the replica flame of the present invention taken in the direction of arrow 5 in FIG. 4.
Figure 6:
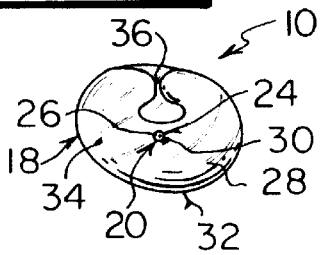
FIG. 6 is a perspective view of the upper portion of the candle, showing the elongated rigid pin of the replica flame of the present invention inserted into the top end of the candle and the wick of the candle pressed into a vertical groove on one side of the pair shaped member.
Figure 6:
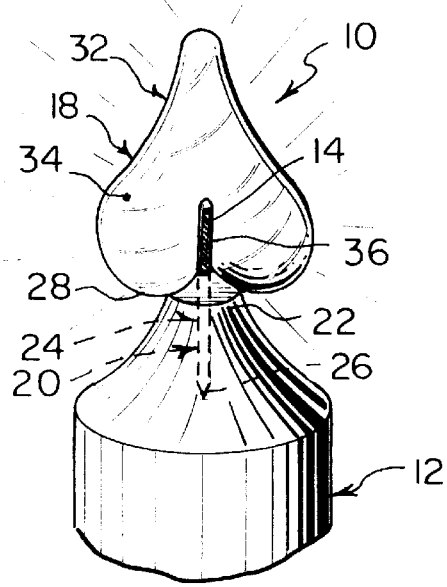

As shown in FIGS. 4, 5 and 6, the pear shaped member 32 can be formed of a single element having a vertical groove 36 on one side thereof. FIG. 4 illustrates securing and releasing of the replica flame 10 to the candle 12. The replica flame 10 is moved in the direction indicated by the arrow labeled with the numeral 50 in order to connect with the candle 12. The replica flame 10 is moved in the opposing direction in order to release the replica flame 10 from its engagement with the candle 12.

A vertical groove 36 is provided on a side of the pear shaped member 32 for receiving the wick 14 of the candle 12 once the rigid pin 24 is connected to the top end 22 of the candle 12. Upon inserting the rigid pin 24 into the top 22 of the candle 12, the wick is taken by a user and secured within the groove 36 on a side of the pear shaped member 32. When the wick 14 is secured in position within the groove 36, it is prevented from extending to a side of the replica flame 10 and diminish the illusionary effect of the replica flame 10.

Figure 7A:
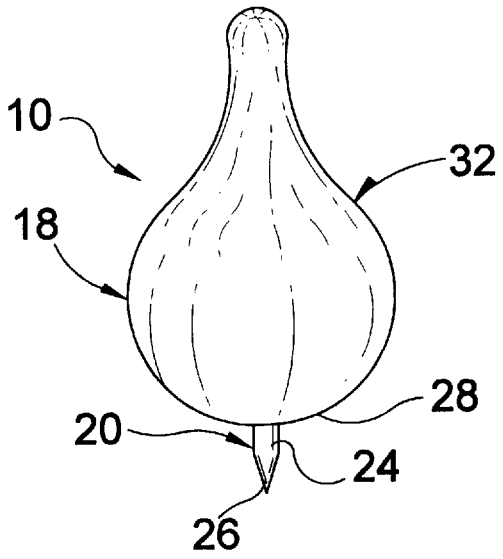
FIG. 7A is a top perspective view of the replica flame of the present invention shown in FIG. 7 wherein the pin and flame body are integrally connected.
Figure 7B:
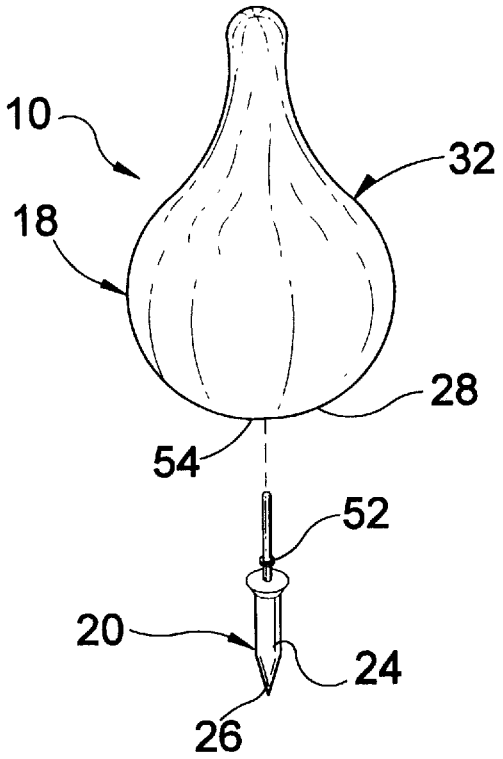
FIG. 7B is a top perspective view of the replica flame of the present invention shown in FIG. 7 wherein the pin and flame body are separable.

Alternatively, the pear shaped member 32 can be provided as a single structure without a groove for receiving the wick 14 as illustrated in FIGS. 7 and 7A or the pin 20 and pear shaped member 32 may be separable as illustrated in FIG. 7B. The pear shaped member 32 shown in FIGS. 7, 7A and 7B allows the wick 14 to either extend from an underside thereof or the alternatively, the wick 14 may be positioned adjacent the rigid pin 24 and extend into the top side 22 of the candle 12 therewith. FIGS. 7 and 7A illustrate the pin 20 and pear shaped member 32 being integrally connected as a single piece structure. Alternatively, the pin 20 and pear shaped member 32 may be formed as separate elements which are readily connected as illustrated in FIG. 7B. In the two piece structure illustrated in FIG. 7B, the pin 20 includes a connector 52 which connects to an underside 54 of the pear shaped member 32. The pin 20 and pear shaped member 32 may connect through a snap connection as illustrated or by any other connector means.

The operation of the replica flame 10 will now be described with reference to the figures. In operation, the base of the candle 12 is placed into a socket of the candlestick 16 that is upon a support surface (see FIG. 1). Once inserted in the candlestick 16, the pointed tip 26 of the elongated rigid pin 24 is releasably inserted into the top end 22 of the candle 12 (see FIGS. 2, 3 and 6). The wick 14 is then pressed into the vertical groove 36 on the side of the pear shaped member 32, if so supplied with the vertical groove 36 (see FIGS. 4, 5 and 6) or is positioned between the two equal half segments 38 and 40 if the pear shaped member 32 is formed of first and second half segments pivotally connected together (see FIGS. 1, 2 and 3). The first and second half segments 38 and 40 are secured together with the facility 44 (see FIGS. 1 and 2). The replica flame 10 is now in position atop a candle 12 simulating an actual flame to thereby provide the appearance that the candle is lit while eliminating the possibility of danger caused by a flame atop the candle 12 and eliminating the mess formed by melting wax.

From the above description it can be seen that the replica flame of the present invention is able to overcome the shortcomings of prior art devices by providing a replica flame which is able to simulate a three-dimensional flame connected to a top end of a candle to complete a decorating scheme where a candle is needed and produce a uniquely realistic appearance for a candle which seems lighted, yet is not lighted, thereby being a safe product that will enhance realism to the candle. The replica flame may be formed as a one or two piece structure which is able to be removably connected to a top side of a candle without damaging the candle while accommodating the wick of the candle thereby preventing the wick from protruding from a side of the replica flame. Furthermore, the replica flame of the present invention is simple and easy to use and economical in cost to manufacture.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A replica flame for simulating a flame on a wick extending from a top of a candle positioned in a candlestick, said replica flame comprising:

a) a three-dimensional flame body; and b) a rigid pin extending from a base side of said three-dimensional flame body, said rigid pin having a pointed end opposite said connection with said three-dimensional flame body, said rigid pin being able to pierce the top of the candle for connecting said simulated three-dimensional flame body to the top end of the candle at the wick, wherein said replica flame creates an illusion of a flame burning on the wick of the candle thereby producing the appearance that the candle is lit.

2. The replica flame as recited in claim 1, further including said three-dimensional flame body includes a vertical groove on one side thereof for receiving the wick of the candle.

3. The replica flame as recited in claim 1, wherein said elongated rigid pin is fabricated out of a material selected from any one of metal, plastic, wood, ceramic, any suitable rigid material and any combination thereof.

4. The replica flame as recited in claim 1, wherein said simulated three-dimensional flame body is a pear shaped member having realistic colors of a natural flame duplicated thereon.

5. The replica flame as recited in claim 4, wherein said pear shaped member includes commercial coloring agents imbedded therein and applied onto an outer surface thereof.

6. The replica flame as recited in claim 4, wherein said pear shaped member further includes an additional treatment of glitter material or flame emulating reflecting agents, for optimizing realism as if the candle is really burning.

7. The replica flame as recited in claim 4, wherein said pear shaped member further includes an additional treatment of fluorescent material to optimize realism as if the candle is really burning.

8. The replica flame as recited in claim 4, wherein said pear shaped member is fabricated out of a at least one of papier-mâché, injected/extruded plastic, ceramic, china, glass, porcelain, plaster, wood, metal and any combination thereof.

9. The replica flame as recited in claim 4, wherein said pear shaped member is constructed by a technique selected from the group consisting of stamping, forming, molding and casting.

10. The replica flame as recited in claim 1, wherein said rigid pin is releasably connected to extend from an underside of said three-dimensional flame body.

11. The replica flame as recited in claim 10, wherein said rigid pin further includes a connector for releasably engaging said underside of said three-dimensional flame body.

12. The replica flame as recited in claim 1, wherein said rigid pin is integrally connected to an underside of said three-dimensional flame body.

* * * * *